US012569064B2

(12) United States Patent
Chang et al.

(10) Patent No.: US 12,569,064 B2
(45) Date of Patent: Mar. 10, 2026

(54) SLIDE RAIL ASSEMBLY

(71) Applicant: Nan Juen International Co., Ltd., Taoyuan City (TW)

(72) Inventors: Fu-Tien Chang, Taoyuan City (TW); Feng-Ming Chuang, Taoyuan City (TW); Jia-Zhang Wang, Taoyuan City (TW); Jing Chen, Taoyuan City (TW)

(73) Assignee: Nan Juen International Co., Ltd., Taoyuan City (TW)

( * ) Notice: Subject to any disclaimer, the term of this patent is extended or adjusted under 35 U.S.C. 154(b) by 139 days.

(21) Appl. No.: 18/754,156

(22) Filed: Jun. 26, 2024

(65) Prior Publication Data

US 2025/0098856 A1 Mar. 27, 2025

Related U.S. Application Data

(63) Continuation-in-part of application No. 18/371,418, filed on Sep. 21, 2023.

(51) Int. Cl.

| | |
|---|---|
| ***A47B 88/44*** | (2017.01) |
| ***A47B 88/477*** | (2017.01) |
| ***A47B 88/49*** | (2017.01) |
| ***A47B 88/57*** | (2017.01) |

(52) U.S. Cl.

CPC ..... *A47B 88/49* (2017.01); *A47B 88/477* (2017.01); *A47B 88/57* (2017.01)

(58) Field of Classification Search

CPC ..... A47B 88/40; A47B 88/44; A47B 88/49; A47B 88/57; A47B 88/473; A47B 88/477; A47B 88/493; A47B 2210/0081

USPC ..... 312/334.1, 334.44, 334.46, 333

See application file for complete search history.

(56) References Cited

U.S. PATENT DOCUMENTS

| | | | | | |
|---|---|---|---|---|---|
| 2,277,702 | A * | 3/1942 | Kennedy | A47B 88/49 | 312/334.46 |
| 5,033,805 | A * | 7/1991 | Hobbs | A47B 88/493 | 312/334.46 |
| 5,316,389 | A * | 5/1994 | Hoffman | A47B 88/493 | 384/21 |
| 6,817,685 | B2 * | 11/2004 | Lammens | A47B 88/43 | 312/334.47 |
| 6,935,710 | B2 * | 8/2005 | Chen | A47B 88/487 | 312/334.44 |
| 7,364,244 | B2 * | 4/2008 | Sandoval | H05K 7/1421 | 312/334.46 |
| 7,726,755 | B2 * | 6/2010 | Peng | A47B 88/57 | 312/334.46 |
| 9,854,909 | B1 * | 1/2018 | Chiu | A47B 88/57 | |
| 10,743,658 | B1 * | 8/2020 | Chen | A47B 88/447 | |
| 10,791,834 | B2 * | 10/2020 | Chen | A47B 88/57 | |

(Continued)

*Primary Examiner* — James O Hansen

(57) ABSTRACT

A slide rail assembly includes a first rail with a positioning structure, a second rail displaceable relative to the first rail and providing a concave surface on the back to face the positioning structure, a first stopper pivotally connected to the concave surface corresponding to the first side of the positioning structure, and an operating member movably connected to the second rail and placed on the concave surface so that the operating member is on the side of the first stopper. The slide rail assembly can be installed on the side of the carrier, which can be a server case or drawer, or can be used on servers or furniture.

17 Claims, 17 Drawing Sheets

(56) References Cited

U.S. PATENT DOCUMENTS

2003/0141791 A1* 7/2003 Dubon ..... H05K 7/1489
312/334.44

* cited by examiner

SLIDE RAIL ASSEMBLY

BACKGROUND OF THE INVENTION

1. Field of the Invention

The invention relates to a slide rail assembly in which the operating member pushes the first stopper along the concave surface of the second rail, so that the first stopper does not block the first side of the positioning means, and the slide rail assembly can be applied to server chassis or drawers, as well as servers or furniture.

2. Description of the Related Art

The slide rails generally used in servers are equipped with a stopper on the second rail. When the second rail extends along the first rail, the second rail forms a temporary lock with the first rail through the stoppers. When the third rail is received in the second rail, the third rail will push the stopper to unlock the second rail and the first rail. However, when the server is being repaired, the third rail will be removed together with it. At this time, the second rail cannot be received into the first rail.

SUMMARY OF THE INVENTION

The main object of the present invention is to provide a slide rail assembly in which the operating member is movably connected to the second rail and the operating member is used to push the first stopper along the concave surface of the second rail, so that the operator can easily unlock the second rail and first rail with the operating member.

Another object of the present invention is to provide a slide rail assembly in which the operating member and the first stopper are hidden in the concave surface of the second rail, and the operating member is used to directly drive the first stopper, so that there is no linkage structure between the operating member and the first stopper, which can reduce manufacturing costs, avoid linkage failures, and help improve the efficiency of slide rail thinning.

To achieve the above objects, the technical means adopted by the present invention comprises: a first rail provided with a positioning means; a second rail displaceable relative to the first rail, and the second rail comprising a concave surface located on a back side thereof to face the positioning means of the first rail, a first hole and a second hole; a first stopper pivotally connected to the concave surface, corresponding to the first side of the positioning means of the first rail, and the first stopper comprising a first stop portion located on one end thereof and displaceable relative to the first hole; an operating member, which is movably connected to the second rail, and is placed on the concave surface and located on one side of the first stopper so that when the operating member pushes the first stopper along the concave surface, the first stopper is avoided from blocking the first side of the positioning means of the first rail; a second stopper pivotally connected to the concave surface corresponding to the second side of the positioning means; and an elastic element located in the second hole to undergo displacement, and the elastic element having one end thereof connected to the first stopper and an opposite end thereof connected to the second stopper so that the elastic element provides elasticity to the first stopper and the second stopper.

Preferably, the second rail is provided with a third hole, and one end of the second stopper forms a second stop portion, and the second stop portion can be displaced relative to the third hole.

Preferably, the first stopper further comprises a first hook portion located at the second hole and connected to one end of the elastic element; the second stopper further comprises a second stop portion formed on one end thereof, and a second hook portion formed on an opposite end thereof and located at the second hole and connected to the other end of the elastic element.

Preferably, the first stopper comprises a first hook portion formed on one end thereof, and a first locking groove formed on an opposite end thereof corresponding to the first side of the positioning means of the first rail; the second stopper comprises a second stop portion formed on one end thereof, and a second locking groove formed on an opposite end thereof corresponding to the second side of the positioning means of the first rail.

Preferably, the slide rail assembly further comprises a third rail displaceable relative to the second rail, and the second stopper further comprises a pushing portion formed on one side end thereof, and the second rail is provided with a fourth hole, so that the pushing portion extends from the fourth hole to the front side of the second rail, so that the pushing portion can be displaced relative to the third rail and pushed.

Preferably, the first rail further comprises a positioning base and a positioning hole, and the positioning means is formed by bending on the positioning base, so that the positioning means is placed in the positioning hole and protrudes to the front side of the first rail, and the positioning base is fixed to the back side of the first rail.

Preferably, the first stopper comprises a first inclined surface formed on one side end thereof; the operating member comprises a second inclined surface corresponding to the first inclined surface.

Preferably, the second rail further comprises a first limiting means; the operating member comprises an operating portion, and a second limiting means provided on the operating portion and displaceable relative to the first limiting means of the second rail.

Preferably, the first rail further comprises a starting component, and the first stopper further comprises a starting surface so configured that when the starting surface abuts against the starting component, the first stopper is started.

Preferably, the second rail further comprises an opening, and a necked first limiting piece located at one side of the opening, and the operating member is provided with at least one second limiting piece of an arch bridge to span the necked first limiting piece.

With the help of above-described technical means, the operating member is movably connected to the second rail, the operating member is used to push the first stopper along the concave surface of the second rail, the operating member and the first stopper are both hidden in the concave surface of the second rail, and the operating member is used to directly push the first stopper, so that there is no linkage structure between the operating member and the first stopper. Not only does it allow the operator to easily release the locking state of the second rail and the first rail with the operating member, it also reduces manufacturing costs, avoids linkage failure, and contributes to the thinning of the slide rail.

DETAILED DESCRIPTION OF THE PREFERRED EMBODIMENT

Figure 1:
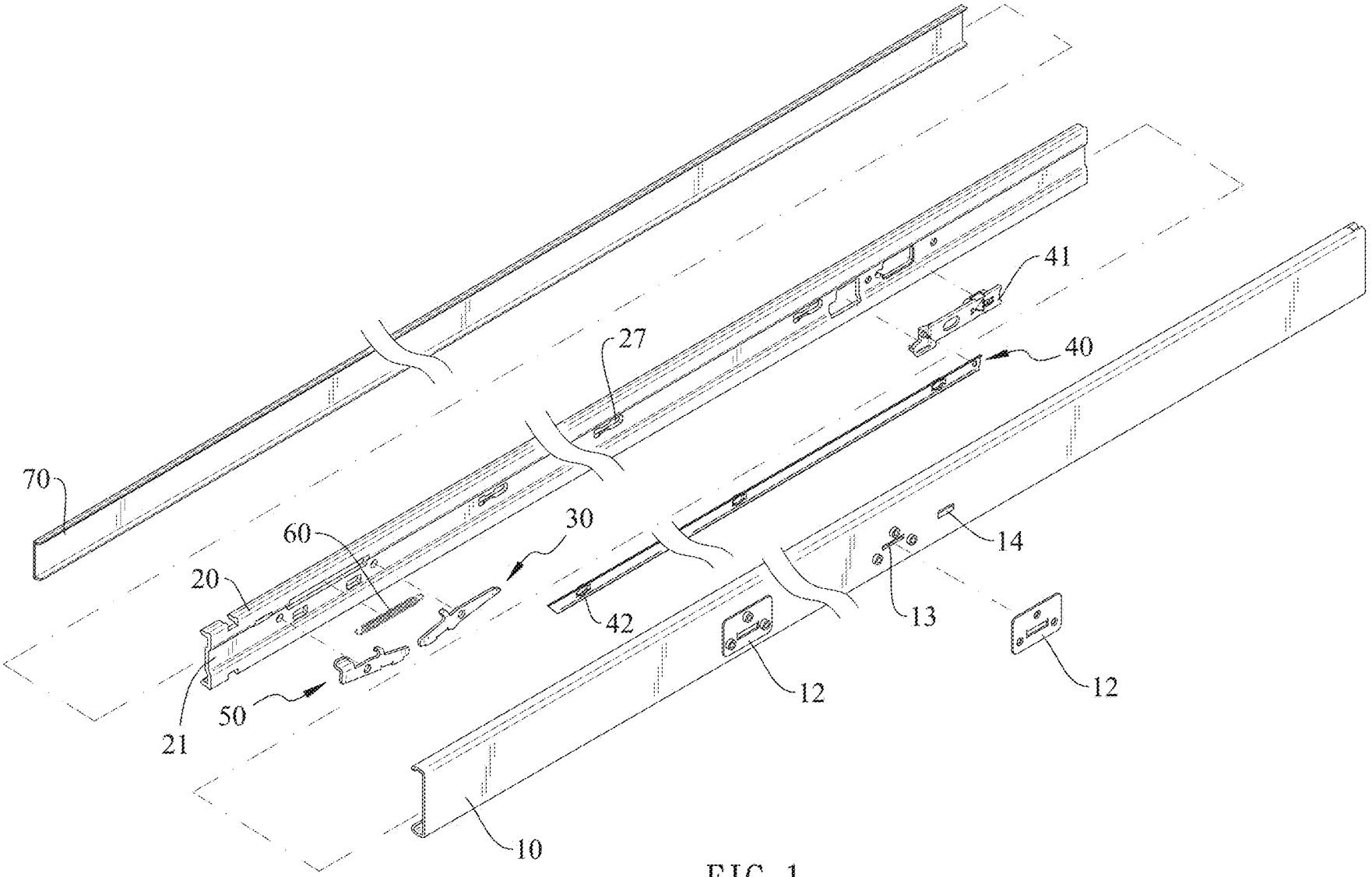
FIG. 1 is an exploded view of a slide rail assembly in accordance with the present invention.
Figure 2:
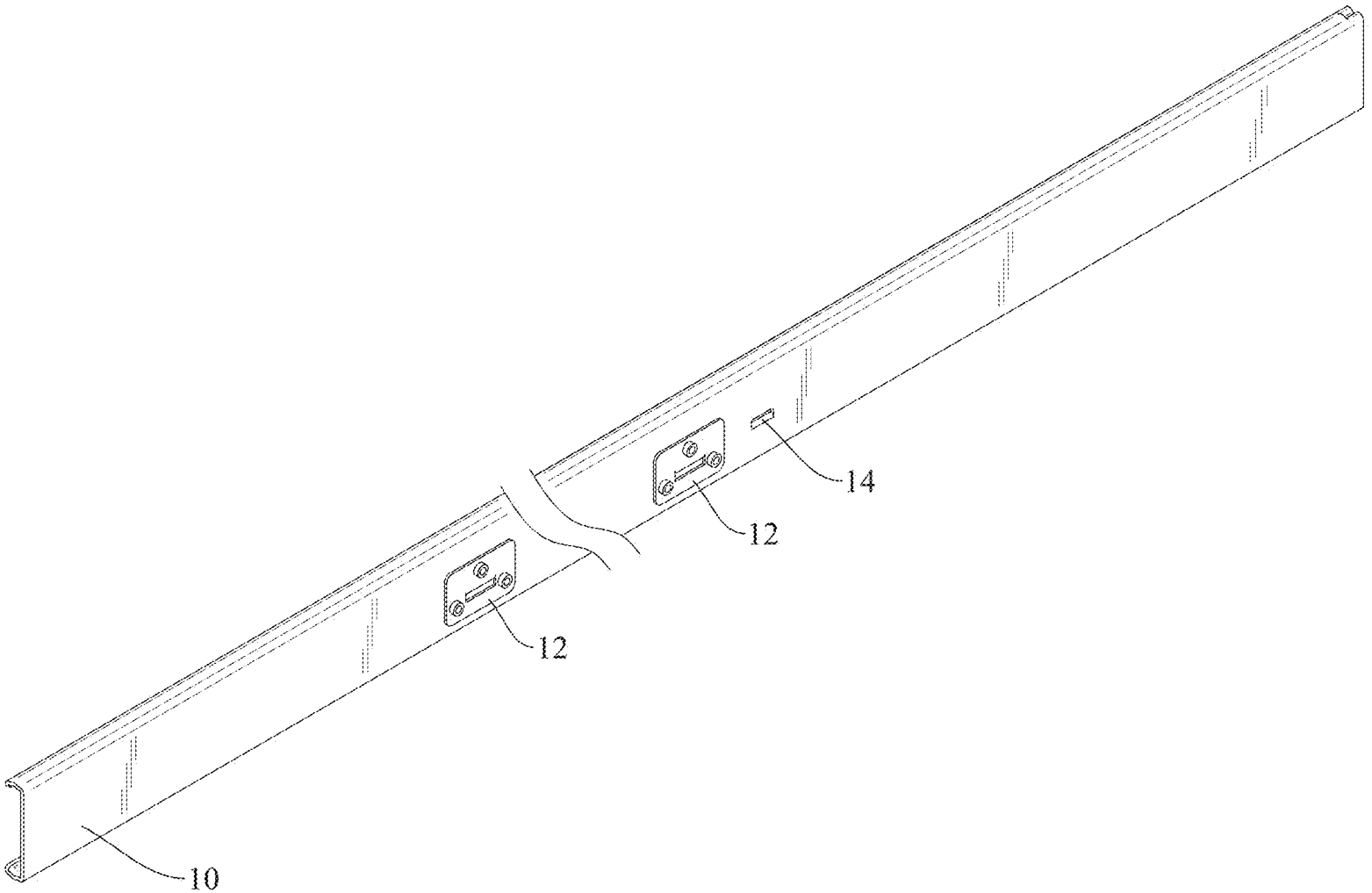
FIG. 2 is an elevational assembly view of the slide rail assembly in accordance with the present invention.

As shown in FIGS. 1 to 6C, the present invention is a slide rail assembly, comprising a first rail 10 equipped with at least one positioning means 11; a second rail 20 displaceable relative to the first rail 10, and comprising a concave surface 21 formed on the back side thereof to face the positioning means 11; a first stopper 30 pivotally connected to the concave surface 21 to correspond to a first side 111 of the positioning means 11; and an operating member 40 movably connected to the second rail 20 and placed in the concave surface 21 so that the operating member 40 is located on the side of the first stopper 30.

Figure 3A:
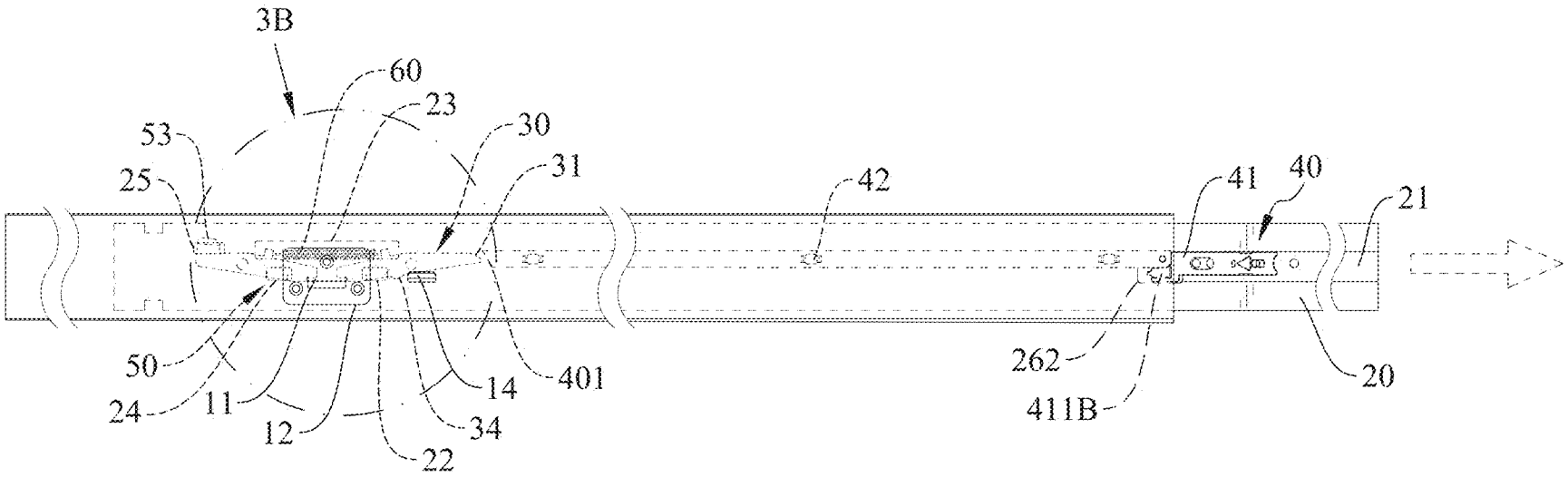
FIG. 3A is a schematic diagram of the positioning means of the second rail of the present invention with the first stopper and the second stopper corresponding to the first rail.
Figure 3B:
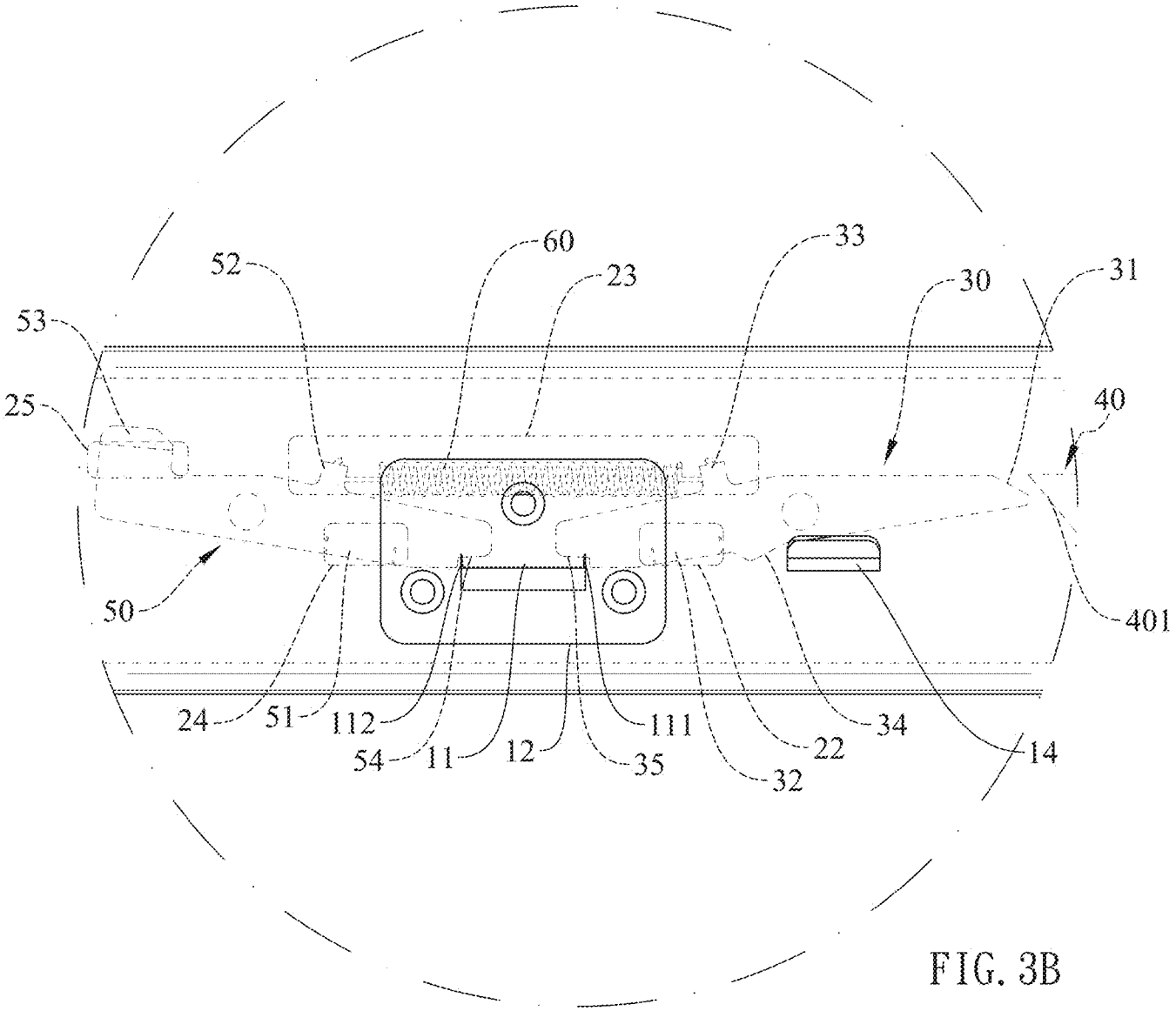
FIG. 3B is an enlarged view of what is shown in FIG. 3A.
Figure 3C:
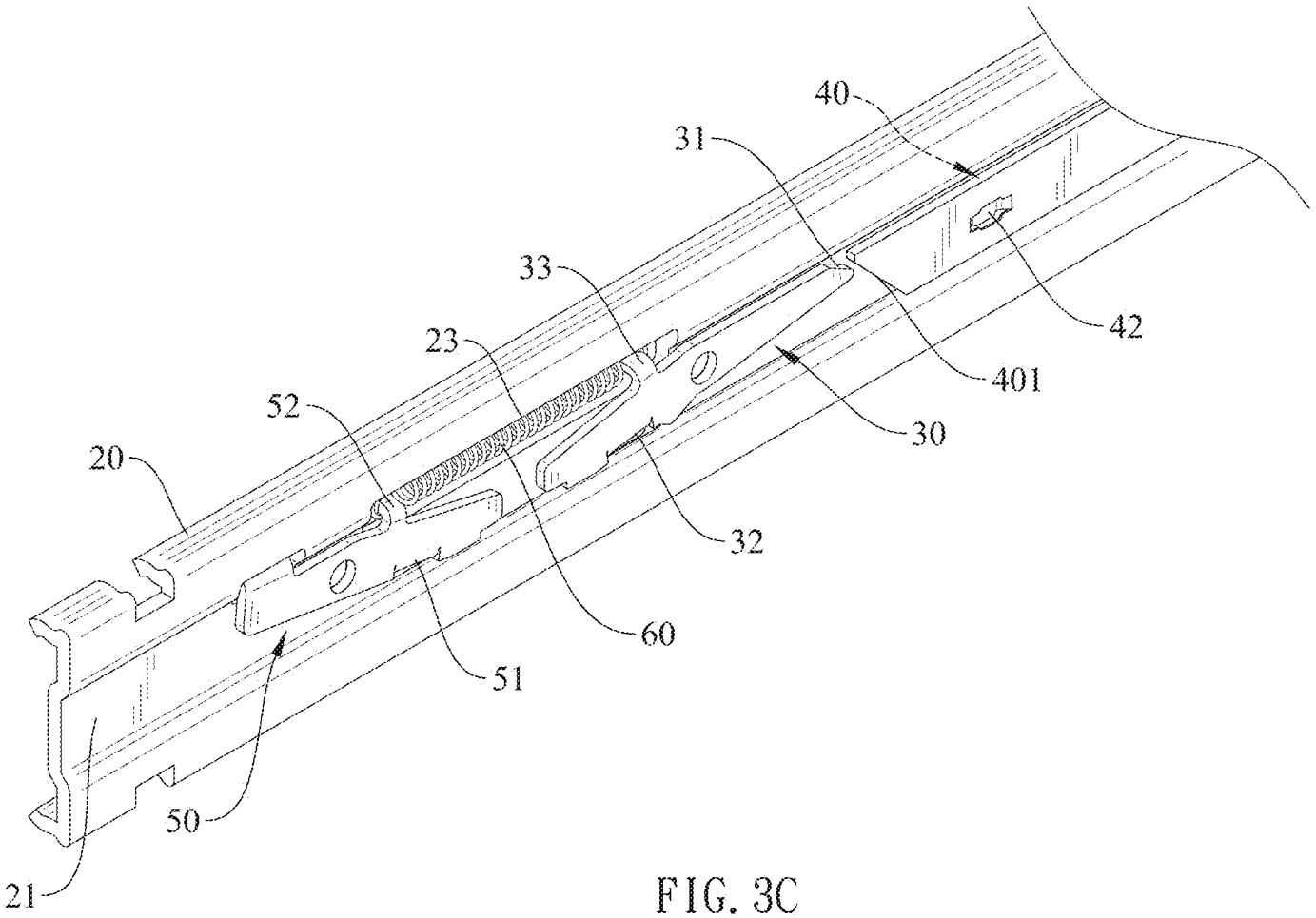
FIG. 3C is a schematic diagram of the operating member located on the side of the first stopper of the present invention.
Figure 4A:
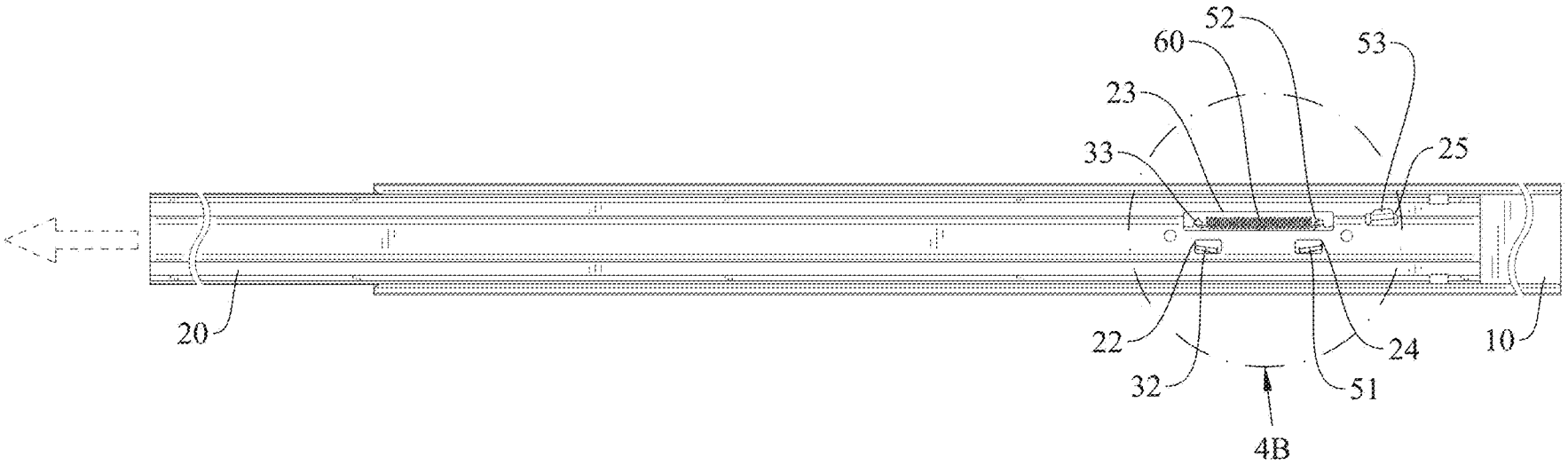
FIG. 4A is a schematic diagram of the second rail of the present invention being temporarily locked to the first rail using the first stopper and the second stopper.
Figure 4B:
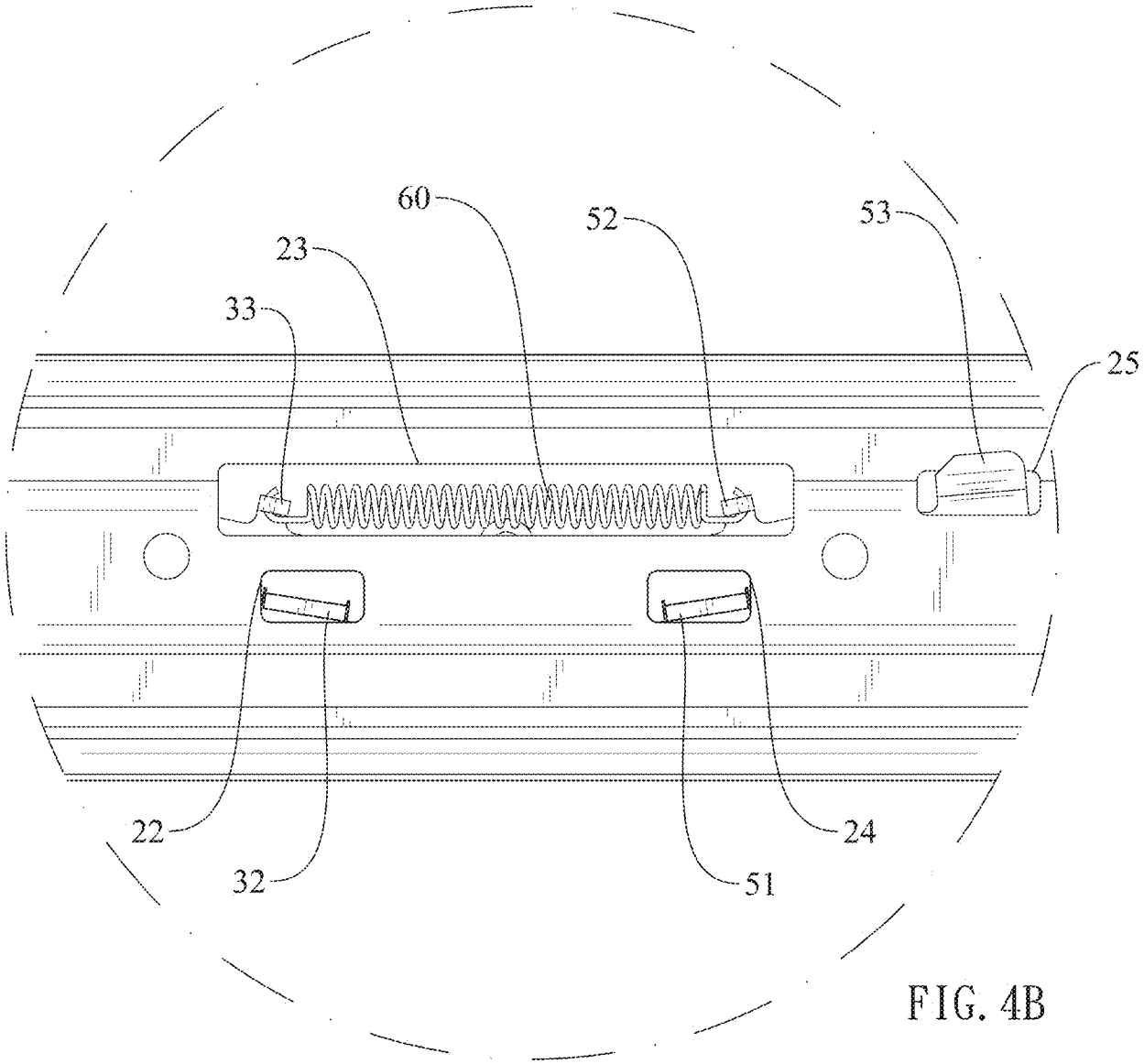
FIG. 4B is an enlarged view of what is shown in FIG. 4A.
Figure 5A:
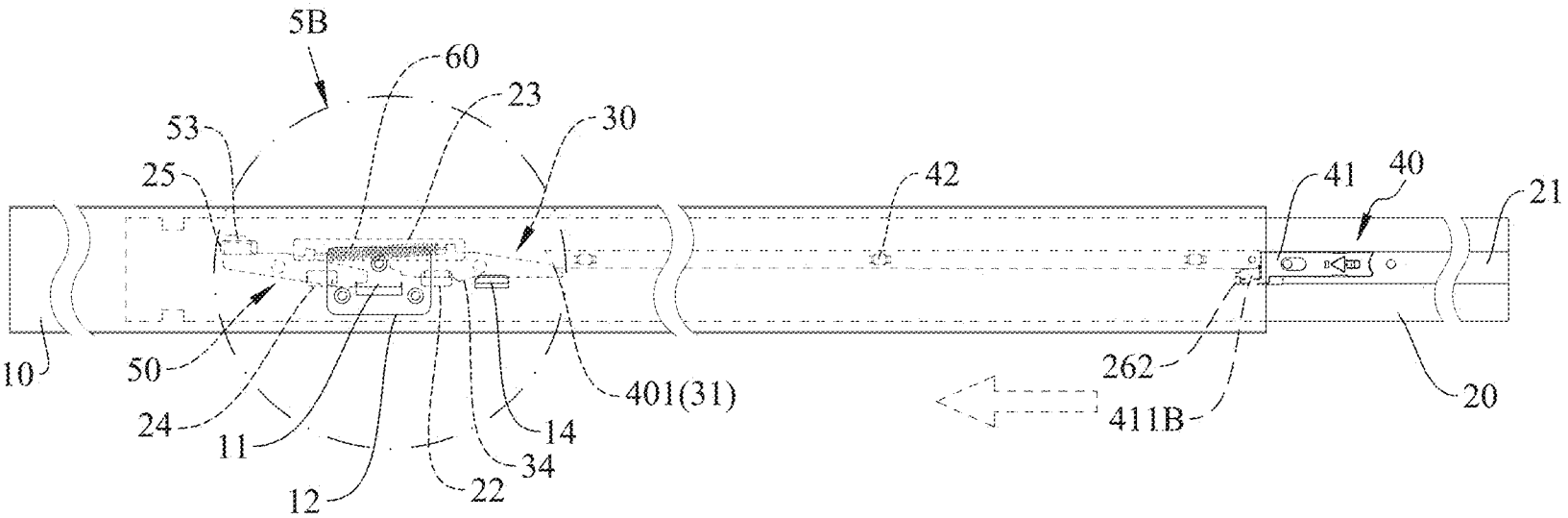
FIG. 5A is a schematic diagram of the operating member of the present invention operating on the second rail.
Figure 5B:
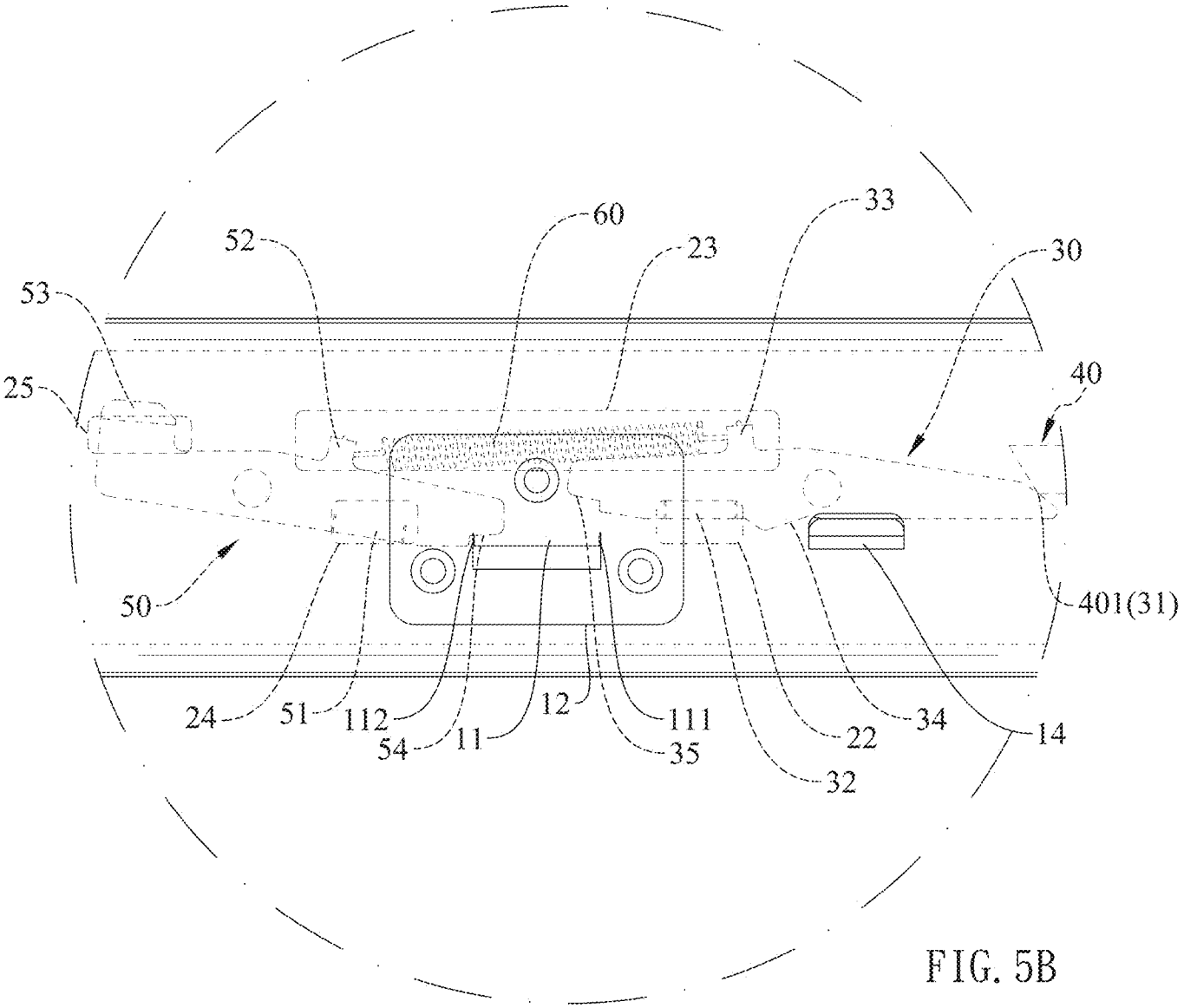
FIG. 5B is an enlarged view of what is shown in FIG. 5A.
Figure 5C:
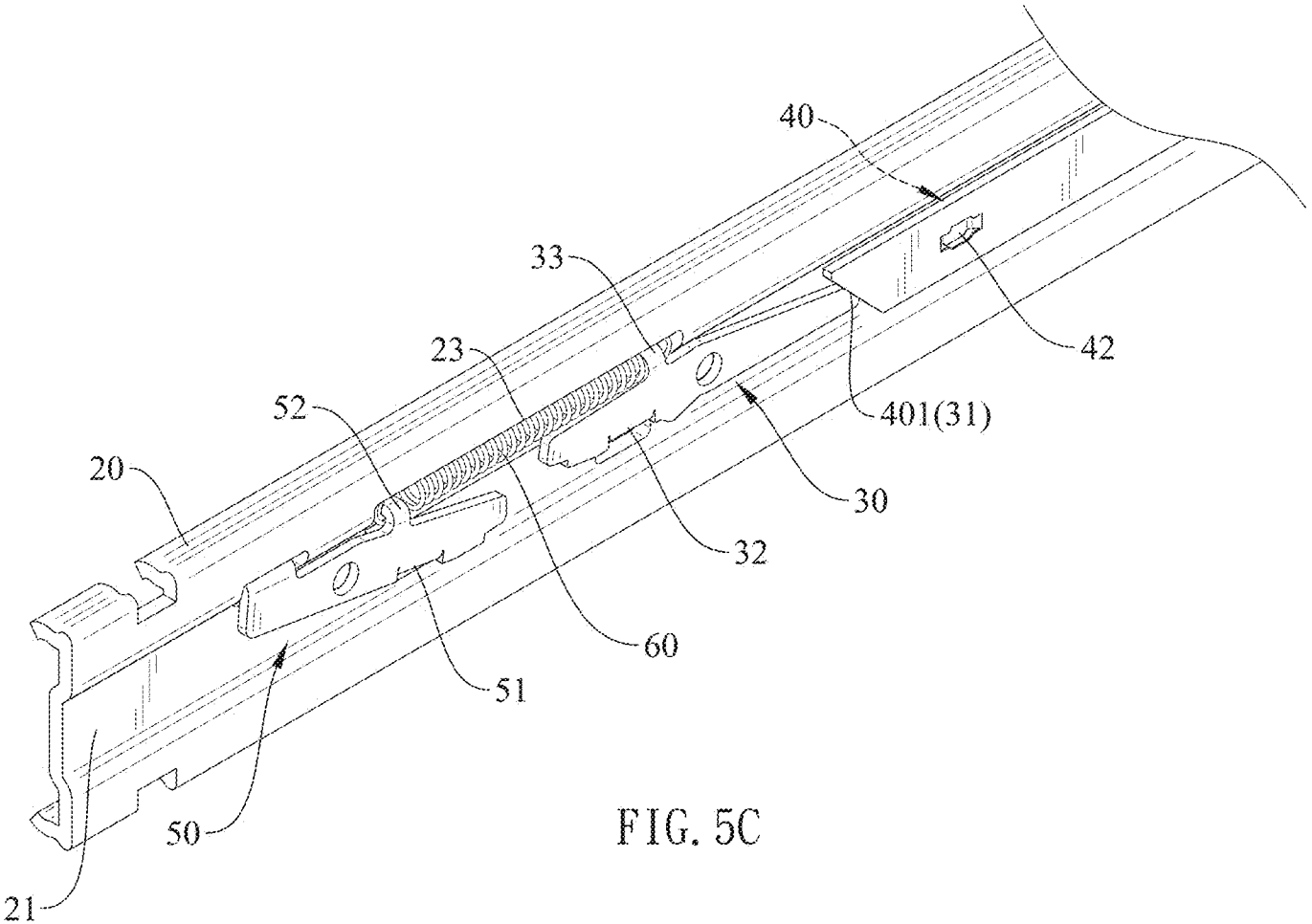
FIG. 5C is a schematic diagram of the operating member pushing the first stopper along the concave surface of the present invention.

As shown in FIGS. 3A, 4A and 5A, when the operating member 40 pushes the first stopper 30 along the concave surface 21, the first stopper 30 does not block the first side 111 of the positioning means 11. As shown in FIG. 3B, FIG. 4B and FIG. 5B, there is a second stopper 50 and an elastic element 60. The second stopper 50 is pivotally connected to the concave surface 21 and the second stopper 50 can correspond to a second side 112 of the positioning means 11. One end of the elastic element 60 is connected to the first stopper 30 and the other end of the elastic element 60 is connected to the second stopper 50, so that the elastic element 60 can provide elasticity to the first stopper 30 and the second stopper 50. In this embodiment, the elastic element 60 is a spring, but it is not limited to this. As shown in FIGS. 3C and 5C, the side end of the first stopper 30 forms a first inclined surface 31, and the operating member 40 has a second inclined surface 401 corresponding to the first inclined surface 31, but is not limited to this.

Following the above, the second rail 20 is provided with a first hole 22, a second hole 23 and a third hole 24. One end of the first stopper 30 forms a first stop portion 32 and one end of the second stopper 50 forms a second stop portion 51, and the first stopper 32 is displaceable relative to the first hole 22. The elastic element 60 is displaceable in the second hole 23 and the second stop portion 51 is displaceable relative to the third hole 24, so the first stop portion 32 is located in the first hole 22 and the second stop portion 51 is located in the third hole 24. A first hook portion 33 is formed on the other end of the first stopper 30. The first hook portion 33 is located in the second hole 23 and is connected to one end of the elastic element 60. The other end of the second stopper 50 forms a second hook portion 52. The second hook portion 52 is located in the second hole 23 and the second hook portion 52 is connected to the other end of the elastic element 60. Moreover, the first stop portion 32 and the second stop portion 51 perform limited displacement in the first hole 22 and the third hole 24, which can also assist the first stopper 30 and the second stopper 50 in reducing the impact and precise displacement during rocking displacement. In this way, the structures of the first stopper 30 and the second stopper 50 that are pivotally connected to the concave surface 21 are prevented from being damaged, but this is not a limitation.

Figure 3D:
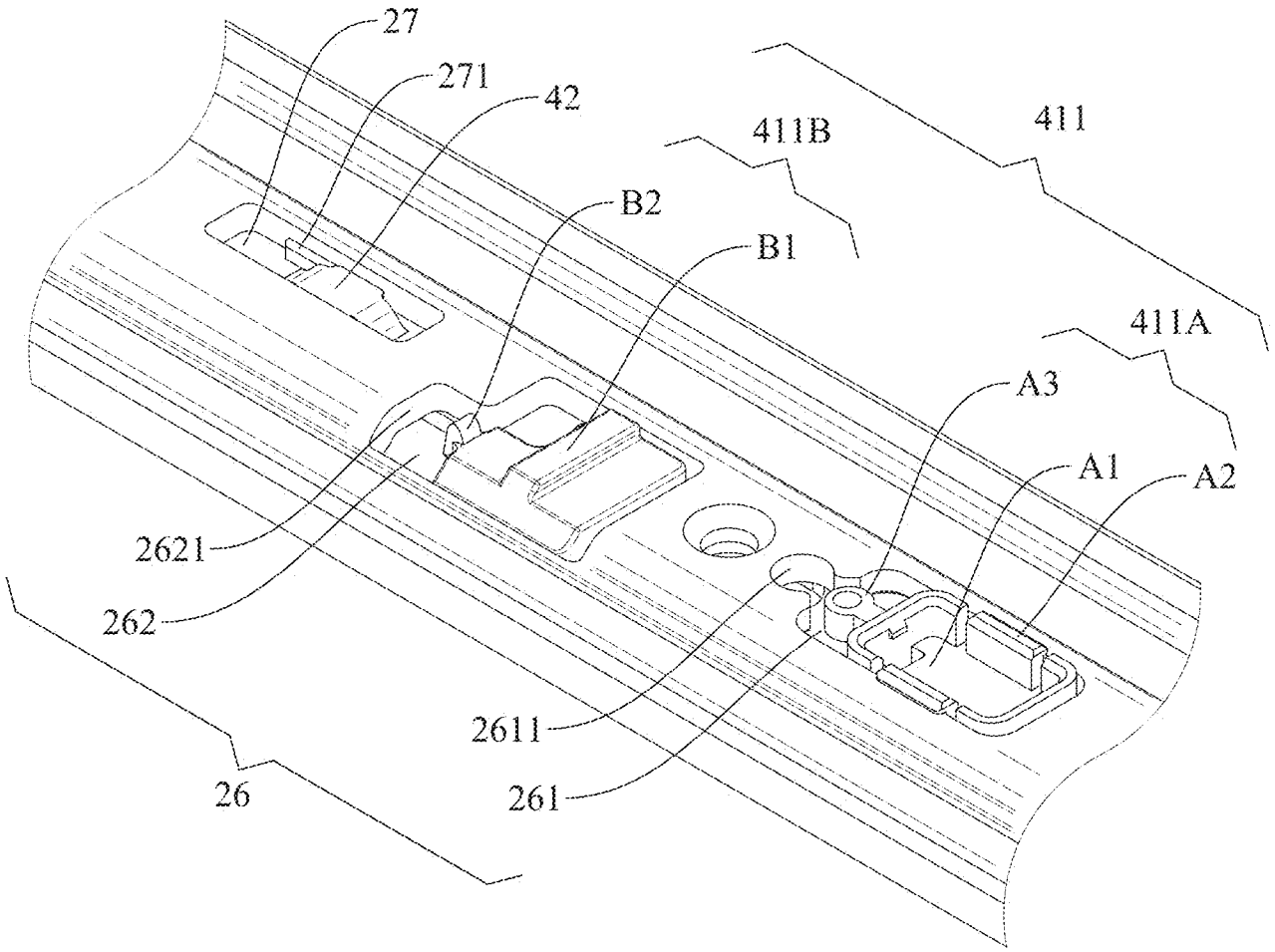
FIG. 3D is a schematic diagram of the second limiting means relative to the first limiting means of the present invention.
Figure 5D:
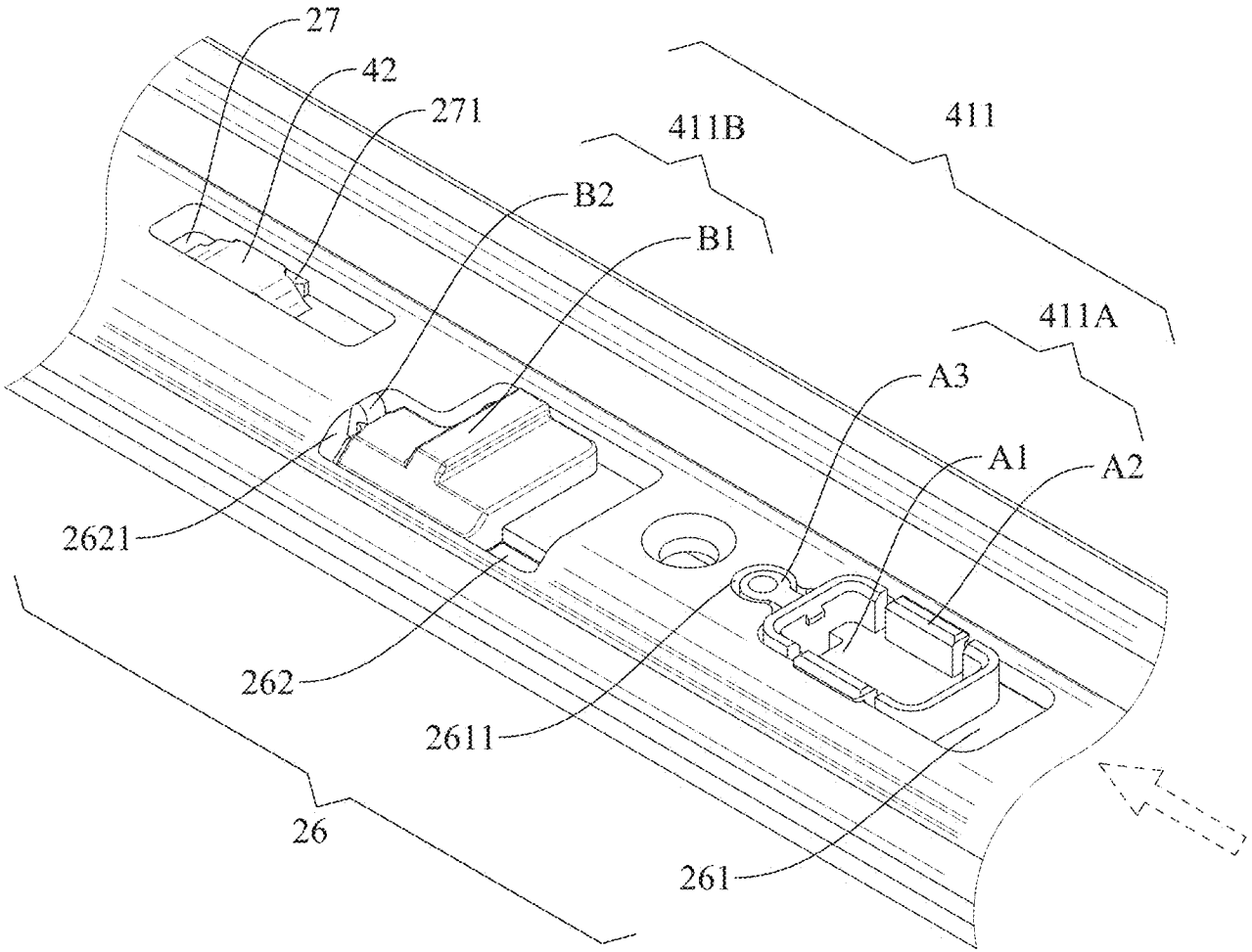
FIG. 5D is a schematic diagram showing that the second limiting means of the present invention can be displaced relative to the first limiting means.

As shown in FIGS. 3D and 5D, the second rail 20 is provided with a first limiting means 26, and the operating member 40 has an operating portion 41. The operating portion 41 is provided with a second limiting means 411, which is displaceable relative to the first limiting means 26. Therefore, the first limiting means 26 is located within the second limiting means 411. The first limiting means 26 can be a first limiting hole 261 or a second limiting hole 262 or a combination of the first limiting hole 261 and the second limiting hole 262. And one side of the first limiting hole 261 forms a first limiting surface 2611 and one side of the second limiting hole 262 forms a second limiting surface 2621. The second limiting means 411 can a first limiting member 411A or a second limiting member 411B or a combination of the first limiting member 411A and the second limiting member 411B. The first limiting member 411A comprises a first body A1, a rib A2 extending from one side of the first body A1, and a first limiting portion A3 extending from the front end of the first body A1. The second limiting member 411B comprises a second body B1 and a second limiting portion B2 extending from the front end of the second body B1. The first limiting portion A3 abuts relative to the first limiting surface 2611 and the second limiting portion B2 engages relative to the second limiting surface 2621, but is not limited to this.

Following the above, the second rail 20 is provided with an opening 27, and a necked first limiting piece 271 is provided on the side of the opening 27. The operating member 40 is provided with at least a second limiting piece 42 of an arch bridge, and the second limiting piece 42 spans the necked first limiting piece 271, but is not limited to this.

Please refer to FIGS. 1 and 2 again. The first rail 10 comprises a positioning base 12 and a positioning hole 13, and the positioning means 11 is formed on the positioning base 12 by bending. The positioning means 11 is inserted into the positioning hole 13 and protrudes to the front side of the first rail 10, and the positioning base 12 is fixed to the back side of the first rail 10, that is, the positioning means 11 in this embodiment is a bent member extending from the positioning base 12 through the positioning hole 13 to the front of the first rail 10, but it is not limited to this.

Please refer to FIGS. 3A and 5A again. The first rail 10 further comprises a starting component 14, and the first stopper 30 has a starting surface 34. The first stopper 30 is started when the starting surface 34 abuts the starting component 14, but is not limited to this.

Please refer to FIGS. 3B and 5B again. The other side end of the first stopper 30 forms a first locking groove 35, and the first locking groove 35 can correspond to the first side 111 of the positioning means 11. The other side end of the second stopper 50 forms a second locking groove 54. The second locking groove 54 can correspond to the second side 112 of the positioning means 11, but is not limited to this.

Figure 5E:
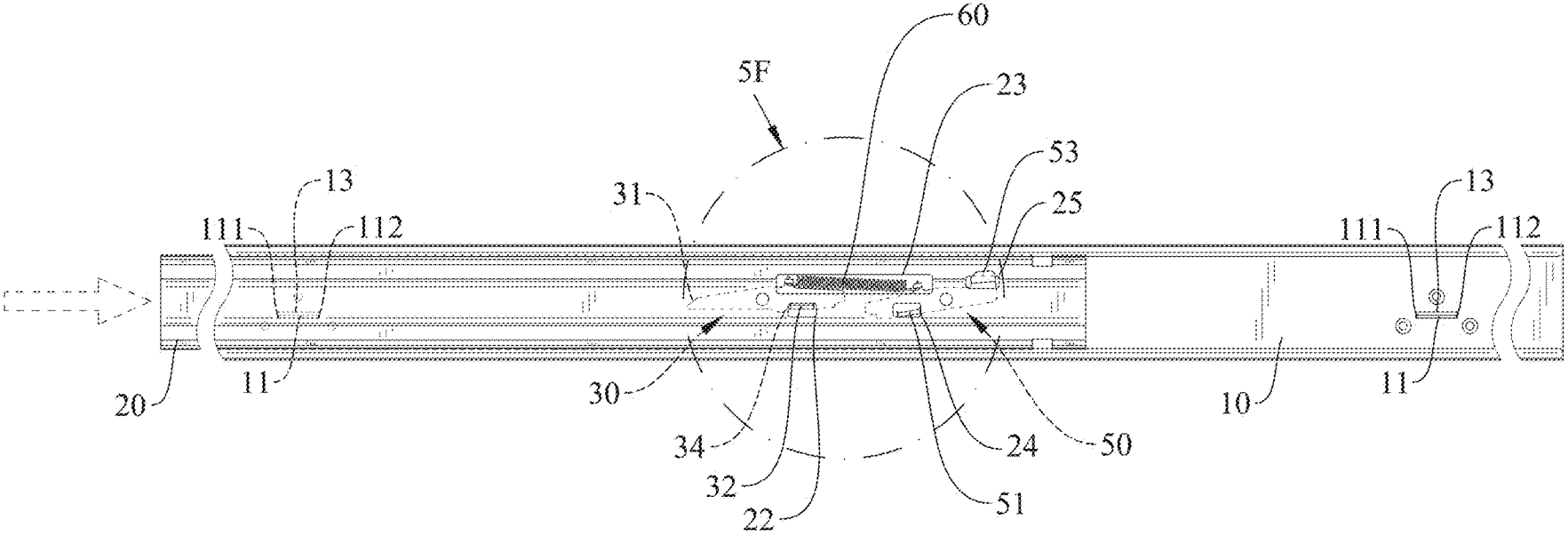
FIG. 5E is a schematic diagram of the present invention in which the first stopper does not block the positioning means and the second rail can be received.
Figure 5F:
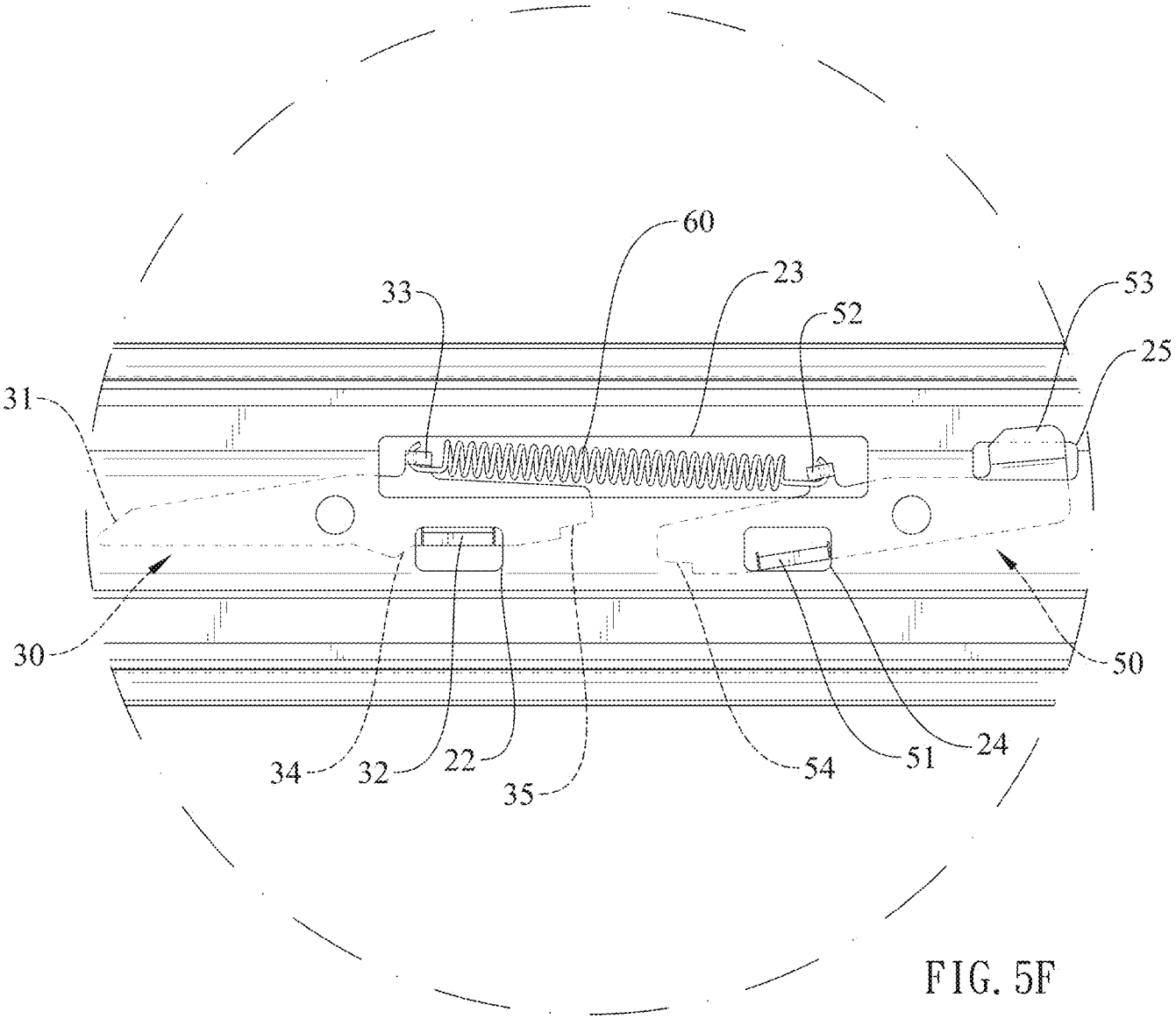
FIG. 5F is an enlarged view of what is shown in FIG. 5E.

As shown in FIGS. 5E and 5F, there can be two positioning means 11, one of which is located at the front section of the first rail 10 so that the second rail 20 can be extended at the first rail 10. When the first stopper 30 does not block the first side 111 of the positioning means 11 located at the front section of the first rail 10, the second rail 20 can be received. The other positioning means 11 is located at the rear section of the first rail 10. When the first stopper 30 blocks the first side 111 of the positioning means 11 located at the rear section of the first rail 10, the second rail 20 can be received at the predetermined position of the first rail 10, but is not limited to this.

Figure 6A:
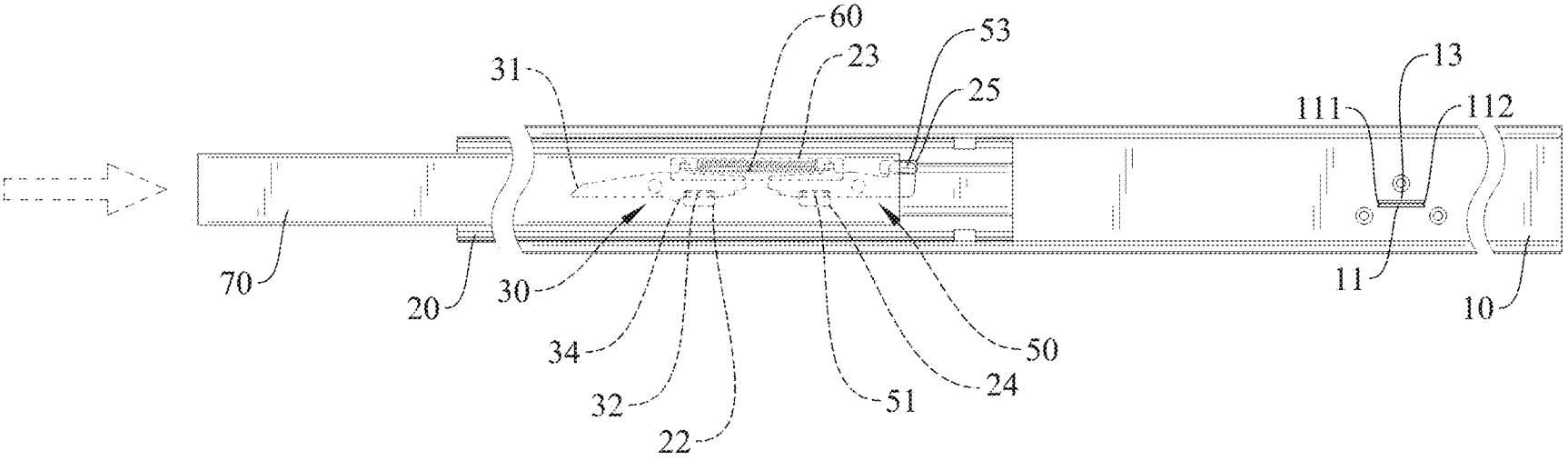
FIG. 6A is a schematic diagram of the present invention, showing the third rail pushing the pushing portion of the second stopper.
Figure 6B:
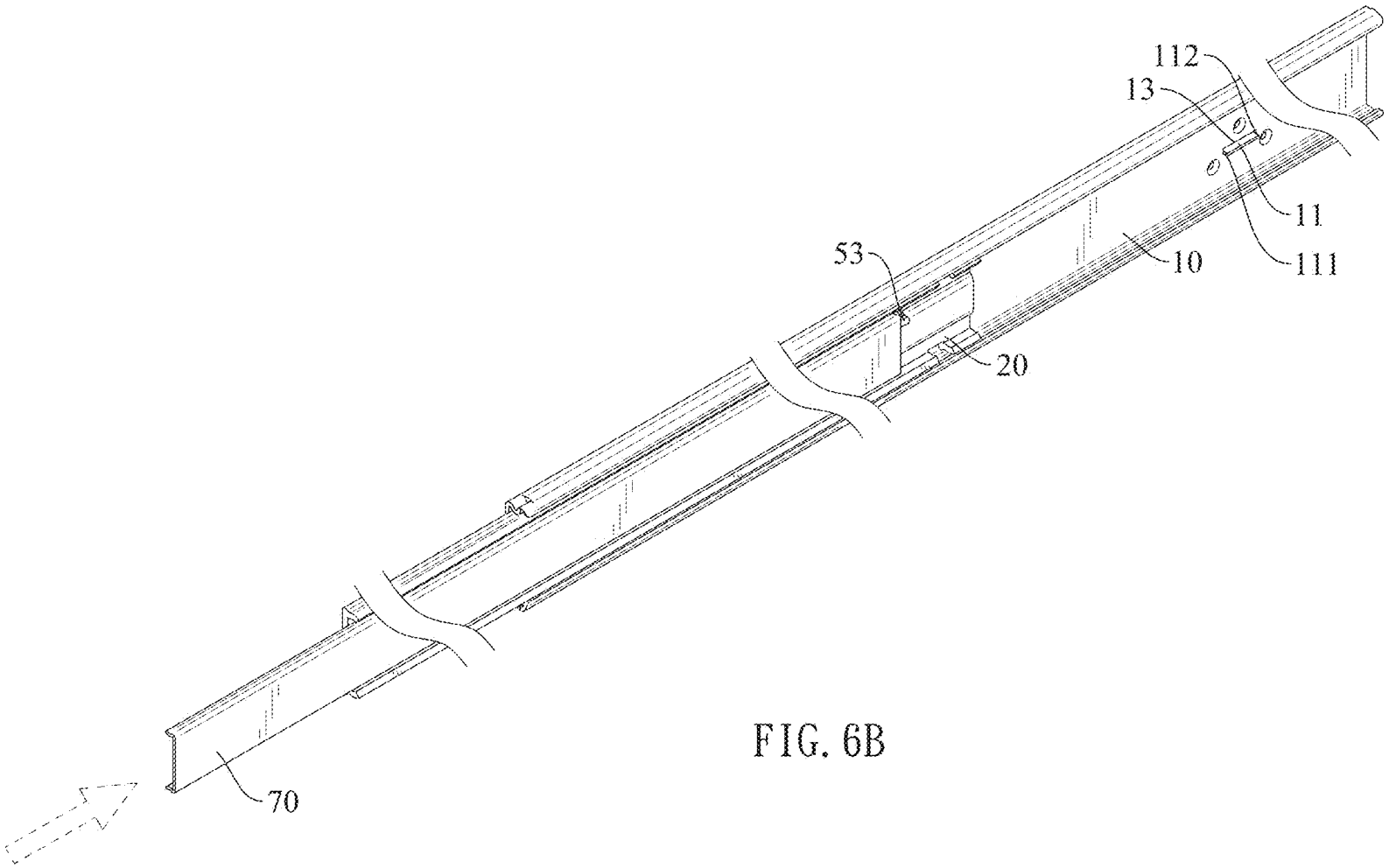
FIG. 6B is an elevational view of the present invention, showing the third rail pushing the pushing portion of the second stopper.
Figure 6C:
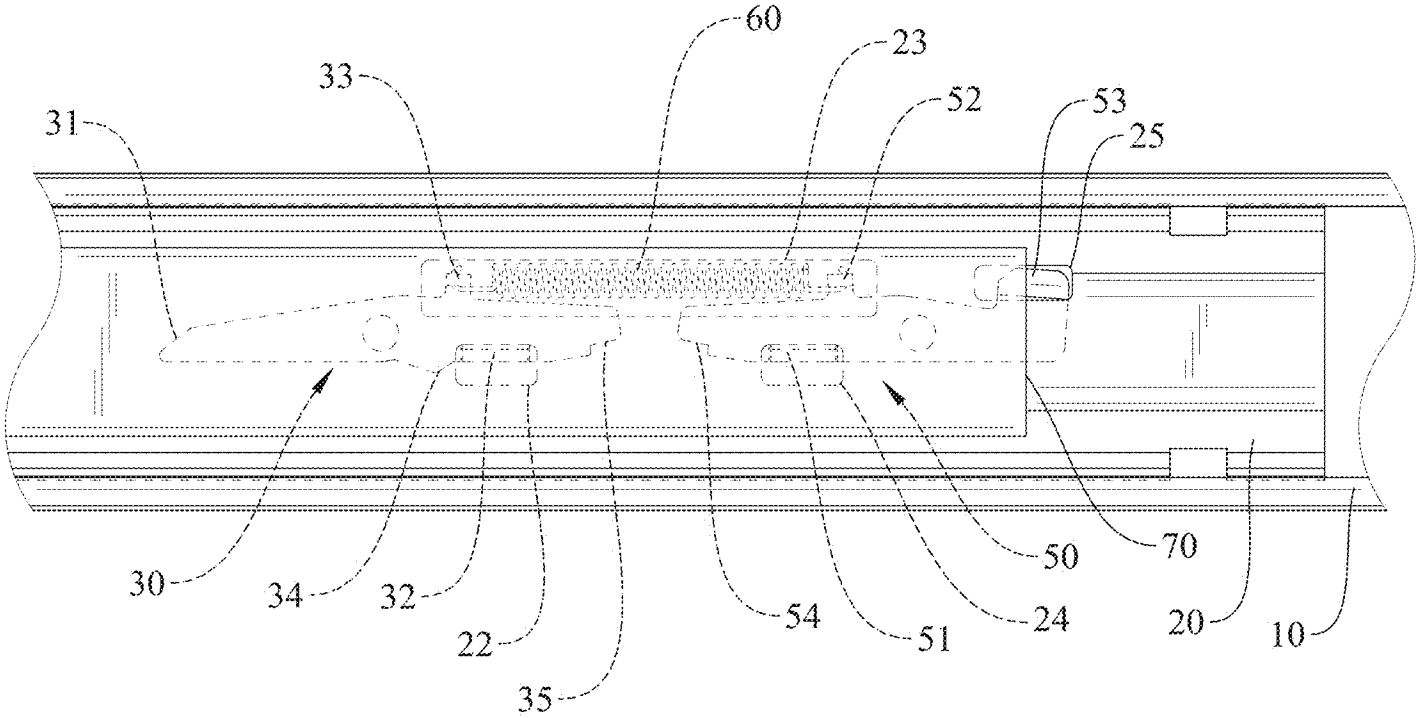
FIG. 6C is a partial schematic diagram of the present invention, showing the third rail pushing the pushing portion of the second stopper.

As shown in FIGS. 6A, 6B and 6C, the slide rail assembly further comprises a third rail 70, which can be displaced relative to the second rail 20. The side end of the second stopper 50 forms a pushing portion 53, and the second rail 20 is provided with a fourth hole 25. The pushing portion 53 extends from the fourth hole 25 to the front of the second rail 20 so that the pushing portion 53 can be displaced relative to the third rail 70 and pushed.

Based on this structure, the operating member 40 is movably connected to the second rail 20, and the operating member 40 pushes the first stopper 30 along the concave surface 21 of the second rail 20. The operating member 40 and the first stopper 30 are both hidden in the concave surface 21 of the second rail 20, and the operating member 40 is used to directly push the first stopper 30 so that there is no linkage structure between the operating member 40 and the first stopper 30. Not only does it allow the operator to easily release the locking state of the second rail 20 and the first rail 10 with the operating member 40, but it also reduces manufacturing costs, avoids linkage failure, and contributes to the thinning of the slide rail. In addition, the first rail 10 can be an outer frame, the second rail 20 can be a middle frame, and the third rail 70 can be an inner frame.

What the invention claimed is:

1. A slide rail assembly, comprising:

a first rail comprising a positioning means, said positioning means comprising a first side and a second side;

a second rail displaceable relative to said first rail, said second rail comprising a concave surface located on a back side thereof to face said positioning means of said first rail, a first hole and a second hole;

a first stopper pivotally connected to said concave surface, corresponding to the said first side of said positioning means of said first rail, said first stopper comprising a first stop portion located on one end thereof and displaceable relative to said first hole;

an operating member movably connected to said second rail, said operating member being placed on said concave surface and located on one side of said first stopper so that when said operating member pushes said first stopper along said concave surface, said first stopper is avoided from blocking the said first side of said positioning means of said first rail;

a second stopper pivotally connected to said concave surface corresponding to the said second side of said positioning means; and an elastic element located in said second hole to undergo displacement, said elastic element having one end thereof connected to said first stopper and an opposite end thereof connected to said second stopper so that said elastic element provides elasticity to said first stopper and said second stopper.

2. The slide rail assembly as claimed in claim 1, wherein said second rail further comprises a third hole; said second stopper comprises a second stop portion formed on one end thereof and displaceable relative to said third hole.

3. The slide rail assembly as claimed in claim 1, wherein said first stopper further comprises a first hook portion located at said second hole and connected to one end of said elastic element; said second stopper further comprises a second stop portion formed on one end thereof and a second hook portion formed on an opposite end thereof, said second hook portion being located at said second hole and connected to the other end of said elastic element.

4. The slide rail assembly as claimed in claim 1, wherein said first stopper comprises a first hook portion formed on one end thereof, and a first locking groove formed on an opposite end thereof corresponding to the said first side of said positioning means of said first rail; said second stopper comprises a second stop portion formed on one end thereof, and a second locking groove formed on an opposite end thereof corresponding to the said second side of said positioning means of said first rail.

5. The slide rail assembly as claimed in claim 1, wherein said first stopper comprises a first inclined surface formed on one side end thereof; said operating member comprises a second inclined surface corresponding to said first inclined surface.

6. The slide rail assembly as claimed in claim 1, wherein said second rail further comprises a first limiting means; said operating member comprises an operating portion, and a second limiting means provided on said operating portion and displaceable relative to said first limiting means of said second rail.

7. The slide rail assembly as claimed in claim 1, wherein said first rail further comprises a starting component, and said first stopper further comprises a starting surface so configured that when said starting surface abuts against said starting component, said first stopper is started.

8. The slide rail assembly as claimed in claim 1, wherein said second rail further comprises an opening, and a necked first limiting piece located at one side of said opening; said operating member is provided with at least one second limiting piece of an arch bridge to span said necked first limiting piece.

9. A slide rail assembly, comprising:

a first rail comprising a positioning means, said positioning means comprising a first side and a second side;

a second rail displaceable relative to said first rail, said second rail comprising a concave surface located on a back side thereof to face said positioning means of said first rail and a fourth hole;

a third rail displaceable relative to said second rail;

a first stopper pivotally connected to said concave surface corresponding to the said first side of said positioning means of said first rail;

an operating member movably connected to said second rail, said operating member being placed on said concave surface and located on one side of said first stopper so that when said operating member pushes said first stopper along said concave surface, said first stopper is avoided from blocking the said first side of said positioning means of said first rail;

a second stopper pivotally connected to said concave surface corresponding to the said second side of said positioning means, said second stopper comprising a pushing portion formed on one side end thereof and extending from said fourth hole to an opposing front side of said second rail, so that said pushing portion is displaced relative to said third rail and pushed; and an elastic element, said elastic element having one end thereof connected to said first stopper and an opposite end thereof connected to said second stopper so that said elastic element provides elasticity to said first stopper and said second stopper.

10. The slide rail assembly as claimed in claim 9, wherein said second rail further comprises a first limiting means; said operating member comprises an operating portion, and a second limiting means provided on said operating portion and displaceable relative to said first limiting means of said second rail.

11. The slide rail assembly as claimed in claim 9, wherein said first rail further comprises a starting component, and said first stopper further comprises a starting surface so configured that when said starting surface abuts against said starting component, said first stopper is started.

12. The slide rail assembly as claimed in claim 9, wherein said second rail further comprises an opening, and a necked first limiting piece located at one side of said opening; said operating member is provided with at least one second limiting piece of an arch bridge to span said necked first limiting piece.

13. A slide rail assembly, comprising:

a first rail comprising a positioning base, a positioning hole and a positioning means, said positioning means being formed by bending on said positioning base, so that said positioning means is placed in said positioning hole and protrudes to a front side of said first rail, said positioning base being fixed to an opposing back side of the first rail, said positioning means comprising a first side;

a second rail displaceable relative to said first rail, said second rail comprising a concave surface located on a back side thereof to face said positioning means of said first rail;

a first stopper pivotally connected to said concave surface corresponding to the said first side of said positioning means of said first rail; and an operating member movably connected to said second rail, said operating member being placed on said concave surface and located on one side of said first stopper so that when said operating member pushes said first stopper along said concave surface, said first stopper is avoided from blocking the said first side of said positioning means of said first rail.

14. The slide rail assembly as claimed in claim 13, wherein said first stopper comprises a first inclined surface formed on one side end thereof; said operating member comprises a second inclined surface corresponding to said first inclined surface.

15. The slide rail assembly as claimed in claim 13, wherein said second rail further comprises a first limiting means; said operating member comprises an operating portion, and a second limiting means provided on said operating portion and displaceable relative to said first limiting means of said second rail.

16. The slide rail assembly as claimed in claim 13, wherein said first rail further comprises a starting component, and said first stopper further comprises a starting surface so configured that when said starting surface abuts against said starting component, said first stopper is started.

17. The slide rail assembly as claimed in claim 13, wherein said second rail further comprises an opening, and a necked first limiting piece located at one side of said opening; said operating member is provided with at least one second limiting piece of an arch bridge to span said necked first limiting piece.

* * * * *